US006525663B2

(12) United States Patent
Colmenarez et al.

(10) Patent No.: US 6,525,663 B2
(45) Date of Patent: Feb. 25, 2003

(54) AUTOMATIC SYSTEM FOR MONITORING PERSONS ENTERING AND LEAVING CHANGING ROOM

(75) Inventors: Antonio Colmenarez, Peekskill, NY (US); Srinivas Gutta, Buchanan, NY (US); Miroslav Trajkovic, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/809,572

(22) Filed: Mar. 15, 2001

(65) Prior Publication Data

US 2002/0167403 A1 Nov. 14, 2002

(51) Int. Cl.[7] ..... G08B 23/00

(52) U.S. Cl. ..... 340/573.1; 340/539; 340/531; 340/689; 340/693.5; 340/692; 340/331; 340/332; 340/565; 340/566

(58) Field of Search ..... 340/573.1, 539, 340/531, 689, 691.1, 693.5, 692, 331, 332, 565, 566

(56) References Cited

U.S. PATENT DOCUMENTS 5,164,703 A * 11/1992 Richman ..... 340/515
5,546,072 A * 8/1996 Creuseremee et al. ..... 340/574
5,793,286 A * 8/1998 Greene ..... 340/522
5,831,669 A * 11/1998 Adrain ..... 348/143
5,850,180 A * 12/1998 Hess ..... 340/541
6,002,427 A * 12/1999 Kipust ..... 348/156
6,097,429 A * 8/2000 Seeley et al. ..... 348/154
6,173,068 B1 * 1/2001 Prokoski ..... 382/115

FOREIGN PATENT DOCUMENTS

| | | | |
|---|---|---|---|
| EP | 0921505 | 6/1999 | ..... G08B/15/00 |
| GB | 2343945 | 5/2000 | ..... G01S/3/786 |
| WO | WO9811520 | 3/1998 | ..... G08B/13/14 |
| WO | WO9959115 | 11/1999 | ..... G08B/13/14 |

* cited by examiner

*Primary Examiner*—Jeffery Hofsass
*Assistant Examiner*—Tai T. Nguyen
(74) *Attorney, Agent, or Firm*—Gregory L. Thorne

(57) ABSTRACT

Briefly, an alarm system monitors the entry and exit of a fitting room. Various devices, including cameras for imaging, are used to scan customers as they enter and leave. Using image analysis, analysis of the audio signature of footfalls, and other criteria, the system attempts to match the images of customers leaving with stored images of customers entering. If no match can be found, an alarm signal is generated.

9 Claims, 3 Drawing Sheets

AUTOMATIC SYSTEM FOR MONITORING PERSONS ENTERING AND LEAVING CHANGING ROOM

BACKGROUND OF THE INVENTION

1. Field of the Invention

The present invention relates to automatic devices that generate an alarm signal when a person attempts to steal clothing from a clothing retailer's changing room by wearing said clothing.

2. Background

The general technology for video recognition of objects and other features that are present in a video data stream is a well-developed and rapidly changing field. One subset of the general problem of programming computers to recognize things in a video signal is the recognition of objects in images captured with a video image. So called blob-recognition, a reference to the first phase of image processing in which closed color fields are identified as potential objects, can provide valuable information, even when the software is not sophisticated enough to classify objects and events with particularity. For example, changes in a visual field can indicate movement with reliability, even though the computer does not determine what is actually moving. Distinct colors painted on objects can allow a computer system to monitor an object painted with those colors without the computer determining what the object is.

Remote security monitoring systems in which a video camera is trained on a subject or area of concern and observed by a trained observer are known in the art. Machine identification of faces is a technology that is also well-developed. In GB 2343945A directed to a system for photographing or recognizing a face, a controller identifies moving faces in a scene and tracks them to permit image-capture sufficient to identify the face or distinctive features thereof. For example, the system could sound an alarm upon recognizing a pulled-down cap or face mask in a jewelry store security system.

A monitored person's physical and emotional state may be determined by a computer for medical diagnostic purposes. For example, U.S. Pat. No. 5,617,855, hereby incorporated by reference as if fully set forth herein, describes a system that classifies characteristics of the face and voice along with electroencephalogram and other diagnostic data to help make diagnoses. The device is aimed at the fields of psychiatry and neurology. This and other such devices, however, are not designed for monitoring persons in their normal environments.

The screening of individuals entering and leaving a clothing retailer's fitting room has been accomplished in various ways. For example, WO 99/59115 describes a system that weighs goods taken into a fitting room and taken out upon leaving. If there is a discrepancy, the system notifies a security person. In EP 921505A2, a picture is taken of any individuals attempting to remove articles with electronic security tags attached to them. The tags are deactivated when the article is purchased. A similar system using radio frequency identification tags is described in WO 98/11520.

There remains in the art a need for a system that permits fitting rooms to be monitored automatically, but unobtrusively. Weighing goods requires that customers be subjected to the inconvenience of placing their articles on a scale. If the articles are incomplete or the system is not monitored, the system could be defeated. Security tags only work when a person leaves a particular area and must be removed, requiring that the retailer inconvenience customers and provide detectors near the exits of the fitting rooms.

SUMMARY OF THE INVENTION

Briefly, a fitting room monitoring system captures images of persons entering and leaving a fitting room or other secure area and compares the images of the same person entering and leaving. To insure that the images are of the same person, face-recognition is used. When the clothing worn or carried by the person entering is different from that worn by the same person as he/she leaves, an alarm is generated notifying a security person.

In an embodiment, the security system transmits the before and after images to permit a human observer to make the comparison. As an alternative to face recognition, the system may use other signature features available in a video signal of a person walking. For example, the height, body size, gait, and other features of the person may be classified and compared for the entering and leaving video signals to insure they are of the same person.

The system may be set up in an area where the customer must walk to enter and leave the fitting room or other venue. Since the conditions are controllable, highly consistent images and video sequences may be obtained. That is, lighting of the subject, camera angle relative to the subject, etc., can be made very consistent.

The system generates a signal that indicates the reliability of its determination that the images indicate the customer is leaving wearing something different from what he/she entered wearing. The reliability may be discounted based on various dress-independent factors, including the duration between the images based on an expected period of time the user remains in the fitting room, correlation of gait, body type, size, height, hair color, hair style, etc. When a reliability of a determination is above a specified threshold, the system generates a signal notifying a security person.

To further insure against the comparison of images of different people (and the resultant false-positives), the fitting rooms may be outfitted with sensors to indicate when they are occupied. The images or video sequences (or classification outputs resulting therefrom) may then be time-tagged. This could be accomplished by any means suitable for determining which room a customer enters. This includes additional cameras. Also, inputs of other modalities may be used in conjunction with video to identify individuals and thereby increase reliability. For example, the sound (e.g., spectral characteristics of sound of footfalls and frequency of gait) of the customer's shoes as the customer walks may be sampled and classified (or the incoming and outgoing raw signals) and compared.

The detection and comparison of clothing may represent a relatively trivial image processing problem because many clothing articles produce distinct video image blobs. It is understood that clothing cannot always be characterized by a homogenous field of color or pattern. For example, a shiny leather or plastic jacket would be broken up. Thus, algorithms for detecting what clothing is preferably do not rely solely on closed fields of color in the video image. Preferably, the outline of the body may be used as a reference guide to permit an image to be segmented and the type of clothing article worn identified in addition to its color characteristics.

The invention will be described in connection with certain preferred embodiments, with reference to the following illustrative figures so that it may be more fully understood.

With reference to the figures, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
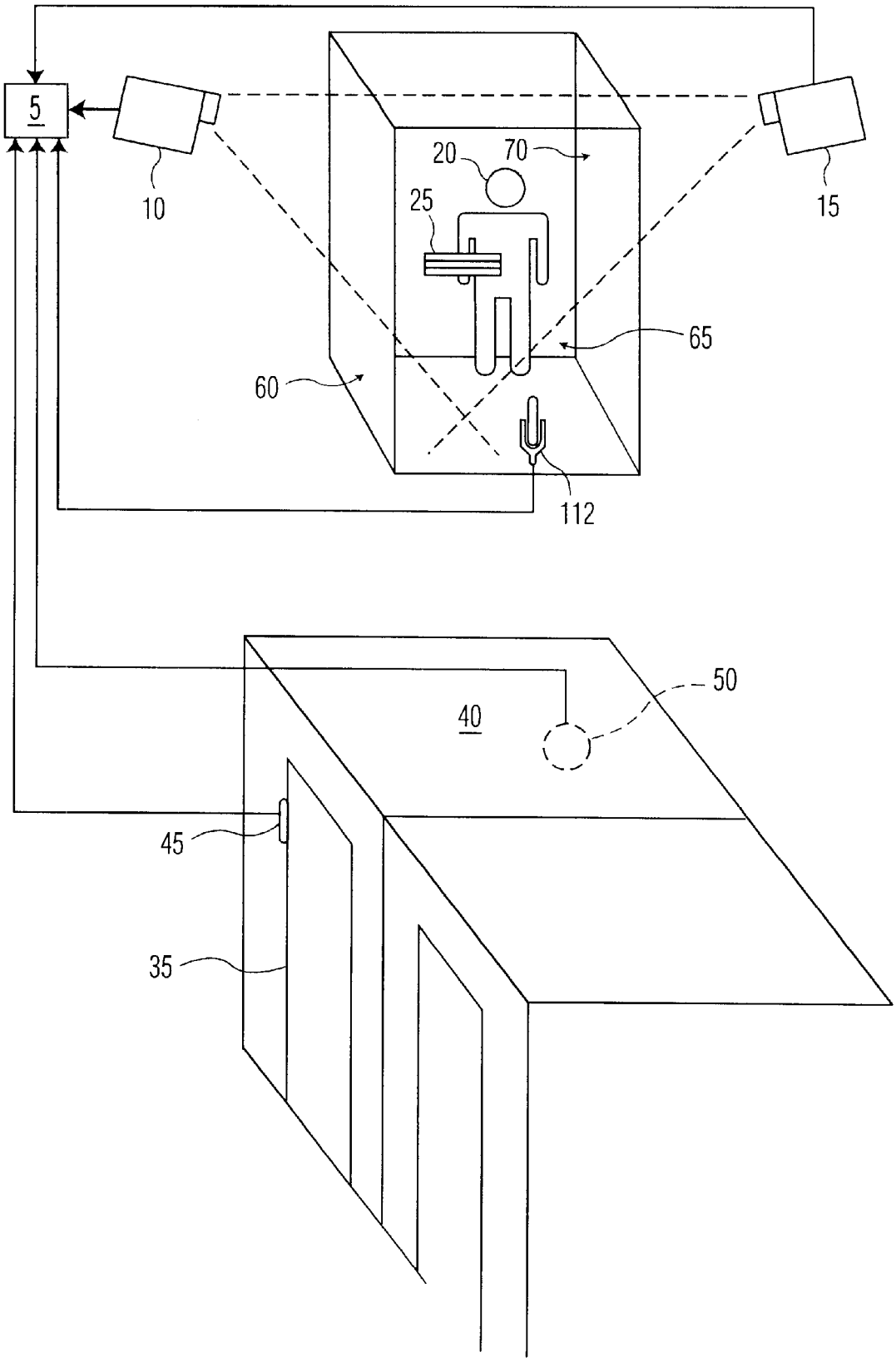
FIG. 1 is a figurative illustration of an application setup for a monitoring system according to an embodiment of the invention.

Referring to FIG. 1, a fitting room monitoring system has a processor 5 connected to various input devices, including a microphone 112, first and second video cameras 10 and 15, respectively, a proximity sensor 50, and a door closure detector switch 45. The first video camera 10 is positioned and aimed to capture a video sequence, or image, of a customer 20 as he/she walks into a fitting room through a passage 65 between first and second apertures 60 and 70. The second video camera 15 is positioned and aimed to capture a video sequence, or image, of the customer 20 as he/she walks through the passage 65 to leave the fitting room. The microphone 112 picks up the sound of the customer's shoes as the customer walks through the passage 65.

Preferably the floor of the passage 65 is of a material that generates a distinct sound for various types of shoes, such as a wood floor (or other hard, resilient material) with a hollow space directly beneath it. The microphone may be attached to the floor and invisible to the customer 20. That is, the vibrations would not be transmitted primarily through the air to the microphone 112 but directly through the floor material.

The passage 65 may or may not be enclosed with the apertures 60 and 70 corresponding to doorways, but it is presumed to be an area through which customers are required to walk.

The proximity sensor 50 is located within a fitting booth 40. The proximity sensor 50 indicates when the fitting booth 40 is occupied. It is assumed that there are multiple fitting booths 40, each with a respective proximity sensor 50. The door closure detector switch 45 indicates when a fitting booth door 35 is closed. Alternatively it could indicate when the fitting room door 35 is opened.

Figure 2:
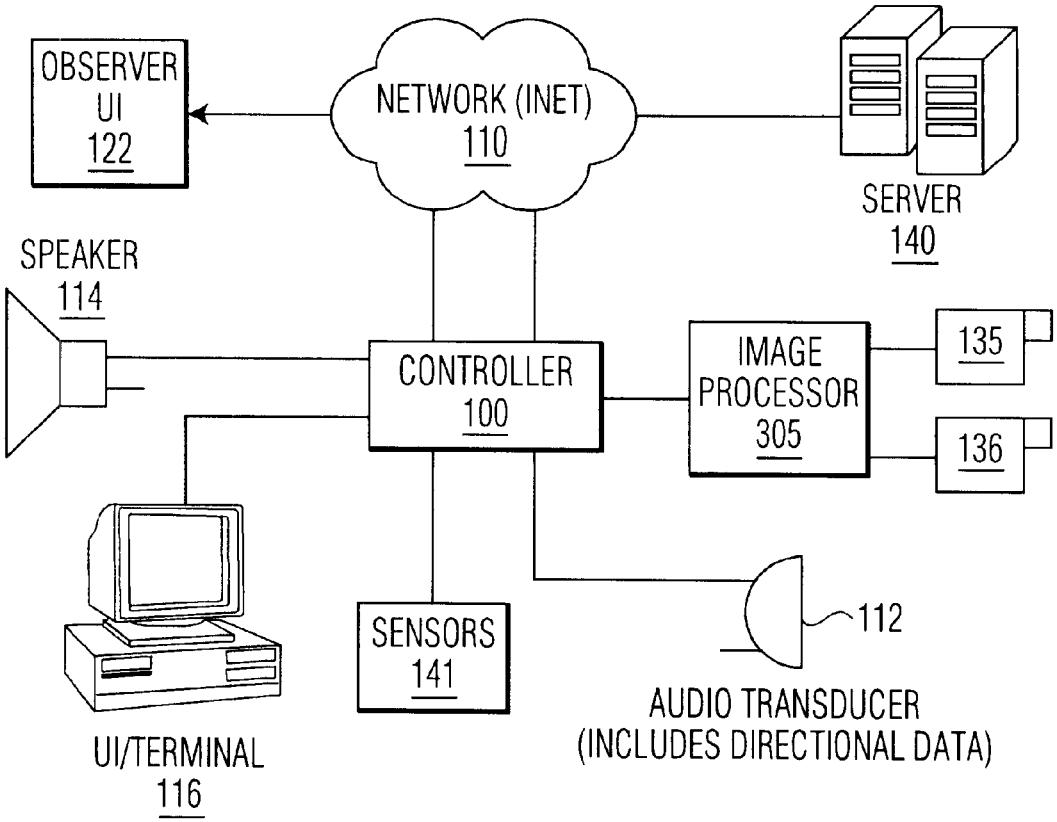
FIG. 2 is a schematic representation of a hardware system capable of supporting a security system according to an embodiment of the invention.

Referring to FIG. 2, further details of the system of FIG. 1 include an image processor 305 connected to cameras 135 and 136, the microphone 112, and any other sensors 141. The cameras may include the cameras 10 and 15 of FIG. 1 and others. The sensors 141 may include the proximity sensors 50 and the switches 45 to indicate the opening and closing of the fitting booth 50 doors 35. The image processor 305 may be a functional part of processor 5 implemented in software or a separate piece of hardware. Data for updating the controller's 100 software or providing other required data, such as templates for modeling its environment, may be gathered through local or wide area or Internet networks symbolized by the cloud at 110. The controller may output audio signals (e.g., synthetic speech or speech from a remote speaker) through a speaker 114 or a device of any other modality. For programming and requesting occupant input, a terminal 116 may be provided. Multimodal integration is discussed generally in "Candidate Level Multimodal Integration System" U.S. Pat. No. 09/718,255, filed Nov. 22, 2000, the entirety of which is hereby incorporated by reference as if fully set forth herein.

Figure 3:
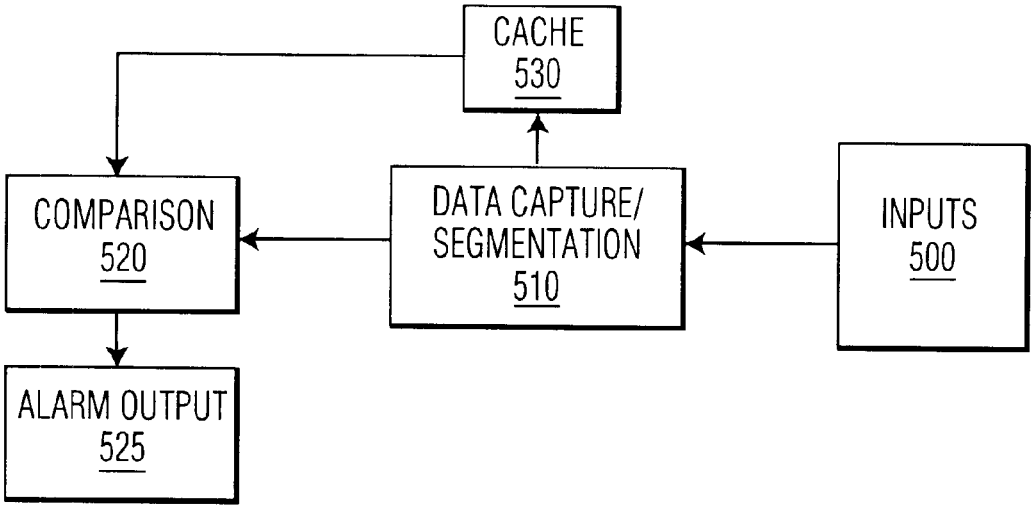
FIG. 3 is a high level block diagram illustrating how inputs of various modalities may be filtered to identify the event of a customer leaving an area wearing different clothes from those worn when entering the area.

FIG. 3 illustrates how information gathered by the controller may be used to identify when a leaving customer is wearing clothes that are different from the ones he/she wore when entering and generate an alarm. Inputs of various modalities 500 such as video data, audio data, etc. are applied to a capture/segmentation process 510, which captures video, image, audio, and other data relating to the customer. The data is used by a comparison engine 520 to determine if each customer leaving is wearing the same clothes as when that person was entering.

The data is captured and segmented into, for example, images, audio clips, video sequences, etc., according to the exact requirements of the comparison mechanism, an embodiment of which is discussed below. The data for each entering customer is stored as a record in a cache 530 (a disk, RAM, flash or other memory device) within the processor 5 when the customer is entering the fitting room. When a customer is leaving the fitting room, the profiler 510 generates the same set of data and applies these to the comparison engine 520. The comparison engine attempts to select the best match between the currently-applied profile and one stored in the cache 530. If a match cannot be found, the comparison engine 520 generates an alarm.

To create a profile for each individual customer, the profiler 510 identifies distinctive features in its input data stream that it can use to model each individual customer. There are countless different ways to accomplish this. One example is developed below.

The video signal may be used to obtain a digital image of the customer (or the cameras 135/136 may be still image cameras). Using known image processing techniques, the region of each image in which the customer's body is located may be separated from the unchanging background. The problem of comparing the images of a customer entering and leaving amounts to comparing two images that are identical except for distortions that result from walking (e.g., arm and leg positions may be different in the respective images) and orientation (the customer may change the angle of his/her approach to the respective camera 135/136).

In the present embodiment, the problem of comparing customer data is reduced to a comparison of images of the entering and leaving customers. The embodiment employs a well-developed analogue to the problem of comparing images of the same person after the person has changed the positions of his/her arms and legs and, somewhat, his/her orientation. In video compression, a motion vector field can often describe the differences between successive video frames fairly well. In this process, the first image is subdivided into portions. Then a search is done for each portion to identify the best match to that portion in the second image; i.e., where that portion may have moved in the second image. Portions of various sizes and shapes can be defined in the images. The process is similar to cutting up one photograph and moving the pieces around to best-approximate a second photograph taken a moment later when objects in the photograph have moved. When this is done in video compression, data describing how the portions of a previous image moved (called a motion vector field or MVF) are transmitted rather than a complete new description of the next image. The MVF rarely results in a perfect description, and data defining the difference between the second image derived from the MVF and the correct image are also transmitted. The latter data are called the residual. If the motion analysis works well for transforming an image of a customer entering into an image of a customer leaving (filtering out the background in both images) there should be relatively little residual. That is, the energy in the residual should be low for the same customer wearing the same clothes and high for different customers or the same customer wearing different clothes.

Figure 4:
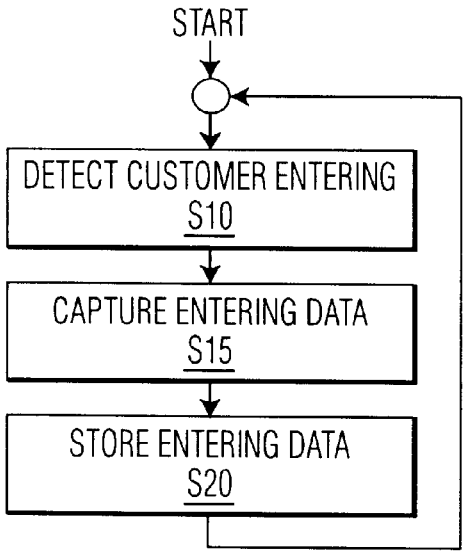
FIG. 4 is a flow chart illustrating a process for storing information on customers entering a fitting room for generating an alarm signal according to an embodiment of the invention.
Figure 5:
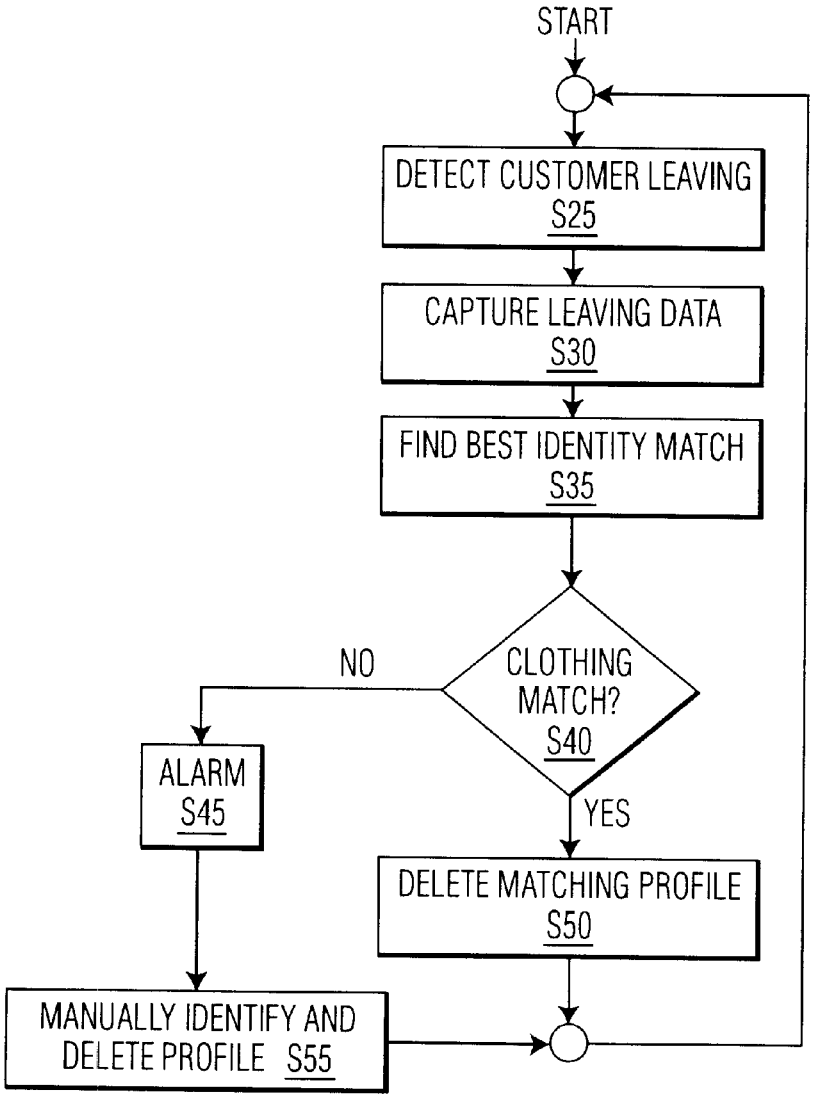
FIG. 5 is a flow chart illustrating a process for determining an alarm condition in response to customers leaving a fitting room according to an embodiment of the invention.

Referring to FIGS. 4 and 5, the determination of whether the customer currently leaving is wearing different clothes from those when he/she entered, boils down to whether an adequate match can be found in the profiles stored in the cache 530. The process of capturing profile data and storing can be described as a simple beginning with the detection of a customer entering S10 followed by the capture and segmentation of data in the input streams S15. The captured data is stored in the cache S20 and the process repeats. Each customer leaving the fitting room is detected S25 and the corresponding image, video, etc. data captured S30. The comparison engine 520 then tries to find the best match among the components indicating the identity of the customer that it can from among the profiles stored in the cache 530 S35. The components indicating the clothing worn by the customer are then compared and the goodness of the match compared with some reference S40. If the clothing does match well and is above the reference the matching profile is deleted S50. If the clothing does not match, an alarm is generated S45. In the latter case, the correct matching profile may then be identified and deleted manually by a security person S55.

The suggested MVF test can be improved if augmented by analysis of proportions and dimensions of the image of the customer. For example, an image of a stout heavy person wearing a given set of clothing styles can be transformed by a MVF accurately into the image of a tall thin person wearing the same style of clothing. Thus, estimates of proportions and absolute dimensions in the customer's image may be added to the profile to improve accuracy.

The comparison may be provided with an ability to tolerate the customer carrying articles differently when leaving that when entering. For example, clothes carried in may be folded and unfolded, or left behind, when leaving. To further improve the robustness of the profiling and comparison process, the system may ignore changes that could result from carrying articles differently in the entering and leaving images. The reference points can be derived from the outline of the body image, color transitions (e.g., face to clothing), etc. Particular regions of the customer's image may be identified, such as the region normally occupied by a shirt and the region normally occupied by a skirt, dress, or pants. Also, regions may be distinguished that might be occulted by articles carried by the customer. The latter regions may be ignored for purposes of determining whether the clothing the user is wearing in the entering and leaving images is the same or different. Alternatively, differences between the entering and leaving images resulting from changes in these regions may be given softer sameness requirement. That is, the system would tolerate a higher energy in the residual corresponding to the portions of the customer's image in which articles carried by the customer are likely to appear.

Still another way to handle this problem is to attempt to determine the region occupied by the carried articles assuming the articles have some color/pattern characteristic and define a distinct blob in the images. Yet another approach is simply to require customers to walk through the passage 65 without carrying anything, such as is done at security check points at airport terminals.

The profiles of entering and leaving customers may be segmented into multiple components, each of which may be required to match to avoid an alarm generation. For example, the total size (image area) of a customer should not change even if other aspects of the profiles match well. Thus, there may be separate limits for each component of the profile. The following are suggestions of components of a profile record. Each is characterized as a indicator, if this component strongly indicates clothing worn is different; an identifier, if this component is expected to be substantially unchanged irrespective of whether the customer changed clothes; and fuzzy, if this component may or may not change depending on whether the customer is carrying articles differently.

| | |
|---|---|
| Image of the body from the knees down | indicator |
| Image of shoulders | indicator |
| Image of arms/sleeves | indicator |
| Image of the center of the body where articles may be carried | fuzzy |
| Absolute width of body | fuzzy |
| Area of image of body | fuzzy |
| Outline of image of body including shoulders and head. | fuzzy |
| Image of the face | identifier |
| Signature of heel clicks | identifier |
| Signature of footfalls (e.g., stride, sound of sole hitting floor) | identifier |
| Motion analysis of gait (e.g., limp, length of stride) | identifier |
| Body habitus (leaning, curved) | identifier |
| Absolute height of body | identifier |
| Presence of glasses, jewelry, piercings, etc. | identifier |
| Hair color and style | identifier |

When identifier components match, the requirements that the indicator and the fuzzy components match may be stiffened. The indicator components may be required to match. If all of the fuzzy components fail to match, this may indicate that the customer's clothing has changed, but the requirement cannot be made too strict or false alarms may result because the customer carried articles differently upon entering and leaving. The following equation may be employed to reduce the goodness of match data.

$$CM = \left(\sum_i F_{ji}\right) \cdot \prod_j N_j \quad IM = \prod_j D_j$$

where CM is an indicator of how well the clothing in the two images matches, IM, an indicator of how well the identity matches (how likely the current person image is of the same person as a profile image), F is a fuzzy component, N is an indicator component, and D is an identity component. The following table shows how the controller may respond to each event as it makes comparisons in steps S35 and S40.

| | CM low | CM high |
|---|---|---|
| ID high | Alarm | delete profile from cache |
| ID low | do nothing/Alarm | do nothing |

Profiles may be given an automatic time to live (be automatically purged after a specified interval) or be purged in response to a command (such as security walk-through). The above set of data may have respective limits corresponding to how well they are required to match. The present application contemplates that the fields of face recognition, audio analysis, etc. may be explored for the best techniques for implementing a defined set of design criteria. The comparison of footfalls may simply compare the intervals between steps that would distinguish a fast walker from a slow one. Or it may consider the frequency profile of the heel click. The area of the body may be made to correspond to a more relaxed matching criterion to account for the fact that the image analysis may add carried articles to the customer's image in determining total area. Face recognition is a well-developed field. The cameras may be given an ability to zoom in on the face and track the customer to provide a high quality image of the face. The criteria for face identity may be made very strong if the quality of the comparison is great since, presumably, the face would not be affected by carried articles.

While in the above embodiments, an image analysis that employed motion decomposition of images was described, it is clear that other methods can be used to implement the present invention. For example, images can be morphed using divergence functions in addition to translation functions to pixel groups to account for such things as the movement of skirts and dresses. The comparison may be based simply on blob color/pattern comparison. Here, the image of the person may be divided into identifiable portions and the color and patterns of corresponding portions compared. Such portions may be defined by using registration points in the image such as the key shapes of head, shoulders, and feet, and informed by a standard body template.

When making comparisons in step S35, certain profiles may be filtered out of the comparison process based upon the status proximity sensor 50 or the door closed detector 45. A profile generated at a certain time, followed by the occupation of a given fitting booth 40 a short time later might be held back from comparison until it indicates that particular fitting booth 40 has been evacuated. Alternatively, the matching requirement applied in step S40 for the particular profile may be stiffened during an interval in which the particular fitting booth 40 remains occupied.

While the present invention has been explained in the context of the preferred embodiments described above, it is to be understood that various changes may be made to those embodiments, and various equivalents may be substituted, without departing from the spirit or scope of the invention, as will be apparent to persons skilled in the relevant art.

What is claimed is:

1. A device for automatically supervising a fitting room, comprising:

a controller programmed to receive first and second monitor signals respectively comprising first and second audio signals from an environment monitor, responsive to a person entering an area and said person leaving said area, respectively;

said controller being programmed to compare said first and second audio signals and to generate an alarm when said first and second audio signals differ beyond a threshold.

2. A device as in claim 1, wherein:

said first and second monitor signals include first and second images of said person entering and said person leaving, respectively;

said controller is programmed to distinguish and compare faces in said first and second images, said alarm being responsive to a result thereof.

3. A device as in claim 1, wherein:

said first and second monitor signals include first and second images of said person entering and said person leaving, respectively;

said controller is programmed to compare portions of said first and second images to generate an image comparison result;

said controller is further programmed such that said alarm signal is more likely to be generated when said comparison result indicates said first and second image portions are very different than when said first and second images are substantially the same.

4. A device as in claim 3, wherein:

said first and second monitor signals include first and second audio signals responsive to said person entering and said person leaving, respectively;

said controller is programmed to compare said first and second audio signals;

said controller is programmed such that when said first and second audio signals match but others of said monitor signals do not match, said controller is programmed to generate an alarm and when said first and second audio signals do not match and said others do not match, said controller is programmed not to generate an alarm.

5. A method of monitoring customers entering and leaving a fitting room, comprising:

imaging a customer entering said fitting room to produce an entering image comprising a head region and an other region;

imaging a customer leaving said fitting room to produce a leaving image comprising a head region and an other region;

storing said entering image;

comparing said leaving image head region with said entering image head region;

comparing said leaving image other region with said entering image other region;

generating an alarm signal when said leaving image head region with said entering image head region match and said leaving image other region and said entering image other region do not match.

6. A method as in claim 5, further comprising:

recording a sound generated by said customer entering to produce an entering audio signal;

recording a sound generated by said customer leaving to produce a leaving audio signal;

comparing said entering and leaving audio signals;

said step of generating including generating said alarm signal responsively to a result of comparing said entering and leaving audio signals.

7. A method of monitoring a fitting room, comprising:

recording images of persons entering said fitting room to create profile records;

imaging persons leaving said fitting room;

comparing at least one first portion of said profile records with a corresponding portion of said images of said persons leaving said fitting room to produce a first comparison;

comparing at least one second portion of said profile records with a corresponding portion of said images of said persons leaving said fitting room to produce a second comparison;

generating a signal responsively to a result of said step of comparing including generating a first signal when a result of said first comparison indicates a match but the results of said second comparison do not indicate a match and generating a second signal otherwise.

8. A program portion stored on a computer readable medium for producing an alarm signal, said program portion comprising a first program segment for receiving images of persons entering an area and for receiving images of persons leaving said area;

a second program segment for comparing at least one first portion of said images of persons entering with a corresponding portion of said images of said persons leaving to produce a first comparison;

a third program segment for comparing at least one second portion of said images of said persons entering with a corresponding portion of said images of said persons leaving to produce a second comparison;

a fourth program portion for generating a signal responsively to a result of said comparing including generating a signal when a result of said first comparison indicates a match but the results of said second comparison do not indicate a match.

9. A device for monitoring an area, said device comprising:

an image input;

a comparator connected to the image input to receive images of persons entering an area and to receive images of persons leaving said area;

said comparator being configured to compare at least one first portion of said images of persons entering with a corresponding portion of said images of said persons leaving to produce a first comparison;

said comparator configured to compare at least one second portion of said images of said persons entering with a corresponding portion of said images of said persons leaving to produce a second comparison;

said comparator configured to generate a signal responsively to a result of said comparing including generating an alarm signal when a result of said first comparison indicates a match but the results of said second comparison do not indicate a match.

* * * * *